US006734643B2

(12) United States Patent
Okamoto et al.

(10) Patent No.: US 6,734,643 B2
(45) **Date of Patent: *May 11, 2004**

(54) LIGHT SOURCE DEVICE

(75) Inventors: Masashi Okamoto, Akashi (JP); Mineo Nakayama, Himeji (JP); Izumi Takaya, Himeji (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 6 days.

This patent is subject to a terminal disclaimer.

(21) Appl. No.: 10/183,446

(22) Filed: Jun. 28, 2002

(65) Prior Publication Data

US 2003/0001515 A1 Jan. 2, 2003

(30) Foreign Application Priority Data

Jun. 29, 2001 (JP) ..... 2001-199152

(51) Int. Cl.[7] ..... H01J 11/04

(52) U.S. Cl. ..... 315/336; 315/335; 315/246; 315/56

(58) Field of Search ..... 315/56, 330, 335, 315/336, 246, 261, 262, 331, 219, 291, 224, 225; 313/594, 620

(56) References Cited

U.S. PATENT DOCUMENTS

| | | | | |
|---|---|---|---|---|
| 3,275,922 A | | 9/1966 | Meyer et al. | |
| 4,223,247 A | | 9/1980 | Jacobs et al. | |
| 4,438,369 A | | 3/1984 | Hicks et al. | |
| 4,447,759 A | | 5/1984 | Moerkens et al. | |
| 4,455,510 A | | 6/1984 | Lesko | |
| 4,488,091 A | | 12/1984 | Muzeroll et al. | |
| 4,539,513 A | | 9/1985 | Ganser et al. | |
| 4,743,810 A | | 5/1988 | Daniels | |
| 4,769,578 A | | 9/1988 | Jacobs et al. | |
| 4,910,437 A | * | 3/1990 | Daniels | 315/208 |
| 4,994,716 A | | 2/1991 | Ganser et al. | |
| 5,233,273 A | * | 8/1993 | Waki et al. | 315/224 |
| 5,397,965 A | | 3/1995 | Gorille et al. | |
| 5,600,208 A | | 2/1997 | Katou et al. | |
| 5,990,633 A | * | 11/1999 | Hirschmann et al. | 315/289 |
| 6,034,477 A | | 3/2000 | Peeters et al. | |
| 6,066,921 A | | 5/2000 | Nakamura et al. | |
| 6,084,354 A | | 7/2000 | Kohmura et al. | |
| 6,194,834 B1 | | 2/2001 | Seiler et al. | |
| 6,483,253 B1 | * | 11/2002 | Okamoto et al. | 315/219 |
| 6,552,502 B2 | * | 4/2003 | Okamoto et al. | 315/336 |
| 2001/0020824 A1 | | 9/2001 | Miyata et al. | |
| 2001/0020825 A1 | | 9/2001 | Miyata et al. | |

FOREIGN PATENT DOCUMENTS

| | | |
|---|---|---|
| EP | 1 135 008 A1 | 9/2001 |
| JP | 37-008045 | 4/1937 |
| JP | 4-026001 | 1/1992 |
| JP | 5-054983 | 3/1993 |
| JP | 6-194957 | 4/1994 |
| JP | 8-315630 | 11/1996 |
| JP | 10-250458 | 9/1998 |
| JP | 10-255507 | 9/1998 |
| JP | 10-302537 | 11/1998 |
| JP | 11-007807 | 1/1999 |
| JP | 11-185982 | 7/1999 |
| JP | 2001-102189 | 4/2001 |
| JP | 2001-126886 | 5/2001 |

* cited by examiner

*Primary Examiner*—James Clinger
*Assistant Examiner*—Jimmy T. Vu
(74) *Attorney, Agent, or Firm*—Nixon Peabody LLP; David S. Safran

(57) ABSTRACT

A discharge lamp which eliminates the large line noise that forms in discharge lamps during startup while preventing heat loss in the transformer by providing a pair of opposed electrodes for the main discharge and an auxiliary electrode arranged such that it does not come into contact with the discharge space for the main discharge, a feed circuit for supplying the discharge current to the electrodes for the main discharge, and a starter circuit which produces a high voltage between one of the electrodes for the main discharge and the auxiliary electrode. The high voltage generating part of the starter circuit which includes at least a high voltage transformer that is separated from the feed circuit while the discharge lamp and the high voltage generating part are formed as an integral unit.

19 Claims, 11 Drawing Sheets

LIGHT SOURCE DEVICE

BACKGROUND OF THE INVENTION

1. Field of the Invention

The invention relates to a light source device using a HID lamp which is used for example as a light source for a projector.

2. Description of the Related Art

In an optical device, such as a liquid crystal projector, a DLP® projector (manufactured by Texas Instruments), a discharge lamp with high radiance lamp (HID), such as a high pressure mercury lamp, a xenon lamp, a metal halide lamp or the like is used. In one such discharge lamp, it is necessary to produce a high voltage using a starter device which will expose the discharge space to an insulation breakdown in order to start a discharge.

FIG. 14 shows the arrangement of a conventional discharge lamp light source device of the series trigger type. In a light source device for an optical device normally a starter (Ui) is used in which a pulsed high voltage is applied between the electrodes (E1, E2) of the two poles of the discharge lamp. In this system, the secondary winding (Si) of the high voltage transformer (Ti) of the starter is series-connected to the discharge lamp (Li). After starting a discharge the function of the starter is no longer necessary. The discharge current supplied to the lamp (Li) must nonetheless flow via the secondary winding (Si) of the high voltage transformer, which has a large number of windings. In order to reduce the loss of heat in the winding (Si), it is necessary to make the wire diameter of the winding large, which inevitably results in the disadvantage of an increase in size and weight of the starter.

One method for avoiding this disadvantage has been to use an outside trigger method which is often used for the trigger of a blinking lamp. In this method, in addition to the first electrode and the second electrode of the two poles which form the main arc discharge after starting, there is provided an auxiliary electrode, positioned between either the first or the second electrode to which a high voltage is applied. This results in dielectric barrier discharge plasma being produced in the discharge space, which then creates the main arc discharge between the first electrode and the second electrode by means of a voltage which has been applied beforehand, i.e., a no-load voltage, by means of a plasma.

In this arrangement, after starting the discharge of the lamp no discharge current the lamp flows through the primary winding and the secondary winding of the high voltage transformer of the starter. Therefore, the primary winding and secondary winding of the high voltage transformer of the starter suffers no heat loss. This method avoids an increase in both the size and weight of the starter.

On the other hand, with regard to the conventional discharge lamp (Li), the discharge lamp (Li) and the feed device (Ni) are connected to one another by feed lines (K1, K2). Additionally, the starter (Ui) unit is located inside the feed device (Ni). This starter (Ui) must produce a high voltage, e.g., a high pulsed voltage, so that the feed lines (K1, K2) are charged in a short time with a high voltage which results in the disadvantage of creating a powerful noise in the lines.

Furthermore, a dulling distortion of the pulsed high voltage is created by an electrostatic buildup which is formed between the feed lines (K1, K2) and any lead in the vicinity, and as well as an inductance of the feed lines (K1, K2). As a result, the buildup of voltage between the lamp electrodes (E1, E2) is therefore reduced. In order to obtain the pulsed voltage necessary for starting the discharge lamp, a larger amount of energy than is normally necessary must be delivered by the starter (Ui) in the direction to the feed lines (K1, K2). In addition, the pulse width is broadened by dulling distortion of the pulsed high voltage which increases the possibility of the formation of an insulation breakdown in an unintended area, such as in the insulation coating of the high voltage transformer (Ti) and the feed lines (K1, K2) or the like. This reduces the reliability of the discharge lamp.

In another method of starting a discharge lamp, a starter, referred to as a DC starter, produces a high voltage where the voltage increases relatively slowly. However, in this instance the insulation breakdown phenomenon is more frequent, as well as resulting in a higher voltage and a longer voltage application time. The disadvantage in this method is an even greater possibility exists for the formation of an insulation breakdown in an unintended area.

As was described above with regard to the outside trigger method, the disadvantage of formation of an insulation breakdown in an unintended area, when using a DC starter, is exactly the same as the series trigger method. For example, Japanese patent publication JP 37-8045 discloses a discharge lamp in which the technique for starting the high pressure discharge lamp is by the outside trigger method. In this arrangement, there is a coil which produces, at the lamp current in the high pressure mercury lamp, a magnetic force. The operation of the starter circuit is controlled so that a high voltage is produced in an auxiliary electrode by the magnetic force.

Furthermore, as described in Japanese patent publication JP 5-54983, a lamp arrangement is disclosed in which in a lamp, such as a high voltage mercury lamp or the like, a plurality of auxiliary electrodes (outside electrodes) are provided which are situated a few millimeters from one another. However, in this conventional light source device, the emission of a powerful line noise and the formation of an insulation breakdown in an unintended area was not considered at all.

SUMMARY OF THE INVENTION

The object of the invention is to eliminate the disadvantages described above, which can be summarized as:

- an undesirable increase in the size or weight of the starter should occurs when attempting to avoid heat loss in the windings;
- an undesirably large noise forms with conventional discharge lamps;
- a greater energy than necessary must be delivered as a result of capacitive coupling, in the vicinity of the starter, between the feed lines and the lead; and
- an increased possibility exists for the formation of an insulation breakdown in an unintended area which reduces the reliability of the device.

In a first embodiment of the invention, a light source device is described in which the following components are connected to one another:

- a discharge lamp (Ld) including a pair of opposed electrodes (E1, E2) for the main arc discharge and in which an auxiliary electrode (Et) is provided so that the auxiliary electrode does not come into contact with the discharge space (Sd) for the main discharge;
- a feed circuit (Bx) for supplying the discharge current to the electrodes (E1, E2) for the main discharge; and a starter circuit which produces a high voltage between the one of the electrodes (E1, E2) forming the main discharge and the auxiliary electrode (Et), The object of the invention is achieved by this embodiment in that the high voltage generating part (Ub) of the starter circuit, which includes at least the high voltage transformer (Te), is separated from the feed circuit part (By) such that the lamp (Ld) and the high voltage generating part (Ub) are formed as an integral unit (Ly).

In another embodiment of the invention, a connector for electrical connection of the feed circuit part (By) to the unit (Ly) has the additional function of a holding means for the high voltage generating part (Ub).

DETAILED DESCRIPTION OF THE INVENTION

Figure 1:
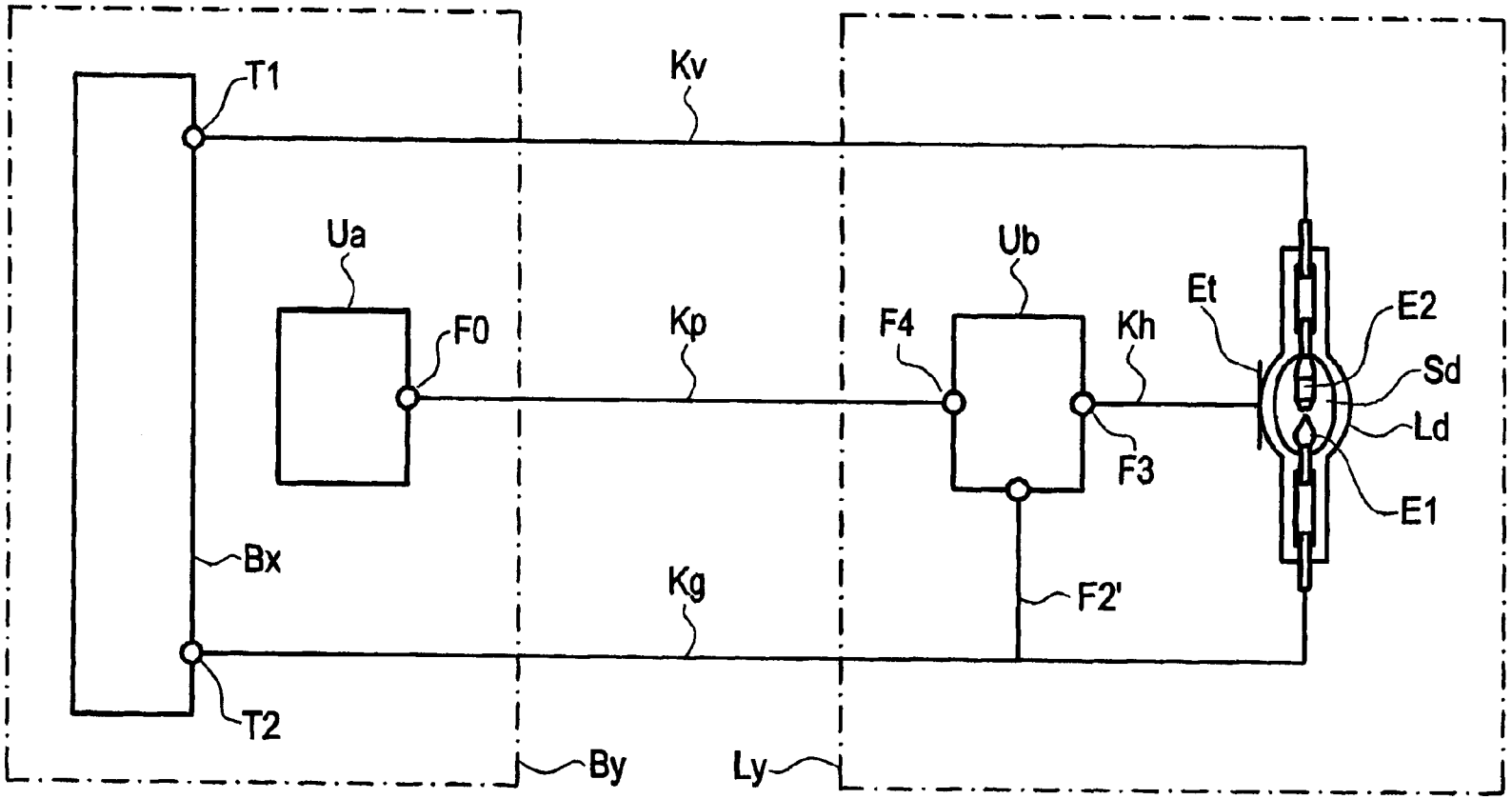
FIG. 1 sets forth a block drawing of a light source device according to a first embodiment of the invention.

The invention is described below according to a first embodiment. FIG. 1 shows the overall arrangement of a light source device of the invention in a simplified block drawing. The high voltage generating part (Ub) of the starter circuit, which comprises at least one high voltage transformer and the lamp (Ld), are formed as an integral lamp unit (Ly).

The starter drive part (Ua) is separate from the high voltage generating part (Ub) of the starter circuit. Here, a case is shown in which the starter drive part (Ua) together with the feed circuit (Bx) for supply of electrical energy for the discharge emission to the lamp (Ld) is located in the feed circuit part (By).

Figure 2:
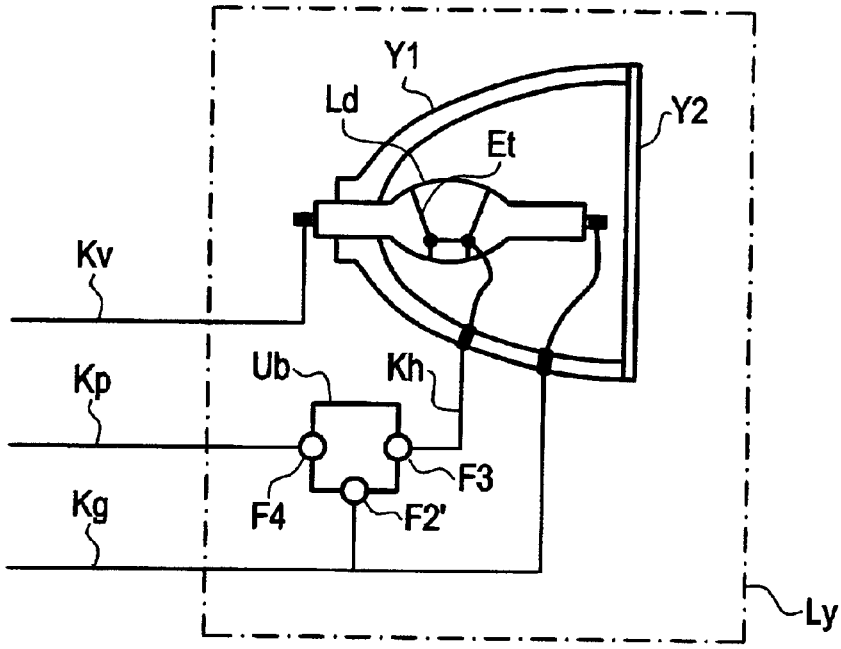
FIG. 2 sets forth a schematic of an arrangement of lamp parts of the light source device according to another embodiment of the invention.

FIG. 2 shows the arrangement of parts of the lamp unit (Ly) of the light source device of the invention in a simplified representation. In the figure, a lamp is described in which a reflector (Y1) for emergence of the emission of the lamp in a certain direction and a light exit window (Y2) which envelops the front side of the reflector (Y1) are used.

The length of the line path (Kh) of the high voltage for connection of the switching part on the secondary side of the high voltage transformer (Te) to the auxiliary electrode (Et) can be reduced since the high voltage generating part (Ub) of the starter circuit including at least the high voltage transformer (Te in FIGS. 5 & 6) is separated from the feed circuit part (By) and that the above lamp (Ld) and the high voltage generating part (Ub) are formed as an integral lamp unit (Ly).

In this embodiment, the electrostatic capacity which is formed between the line path (Kh) of the high voltage for connection of the switching part on the secondary side of the high voltage transformer (Te) to the auxiliary electrode (Et) and the lead in the vicinity can be reduced and the inductance of the line path (Kh) can be decreased.

When the starter produces a pulsed high voltage, the adverse effect due to the dulling distortion of the pulsed high voltage which is caused by the presence of the electrostatic capacity of the line path and the presence of the inductance is suppressed, and the increase of voltage between the lamp electrodes (E1, E2) is reduced. Furthermore, the disadvantage that a greater energy than necessary must be delivered during startup is also eliminated. Also, the possibility that the pulse width is increased by dulling distortion of the pulsed high voltage and that an insulation breakdown forms in an unintended area can be suppressed. Since the length of the line path (Kh) for connection of the switching part on the secondary side of the high voltage transformer (Te) to the auxiliary electrode (Et) can be reduced, as can the loop area, the disadvantage of noise formation can be eliminated.

Because the length of the connecting line between the starter and the auxiliary electrode (Et) is small, the possibility of formation of an insulation breakdown in an unintended area can also be suppressed when the starter produces a high voltage where the voltage increases relatively slowly. Furthermore, the high voltage-carrying lines in the line paths (Kv, Kp, Kg) between the feed circuit part (By) and the lamp unit (Ly) are no longer necessary. As a result, a line with low voltage stability, thin insulation coating and a small coating diameter can be used. Therefore, it is possible to contribute to a reduction in the size of the light source device more than in the case in which a thick, high voltage-carrying line is used. As a result, the installation effort is simplified, and the costs for development and production of the light source device can be reduced.

Moreover, no discharge current of the lamp (Ld) flows in the primary winding (Pe) and the secondary winding (Se) of the high voltage transformer (Te) of the starter, as was described above for the outside trigger method after starting the discharge of the lamp (Ld). In the primary winding (Pe) and the secondary winding (Se) of the high voltage transformer (Tc) of the starter therefore no heat loss arises. Consequently, an increase both in the size and weight of the starter can be avoided.

The arrangement of the light source device of the invention described in this first embodiment eliminates the disadvantages of having to deliver a greater energy than necessary by the starter, of noise, and the danger of insulation breakdown in an unintended area. Additionally, the light source device can be built at low production costs, and an increase both in the size and weight of the starter can be avoided.

Figure 3:
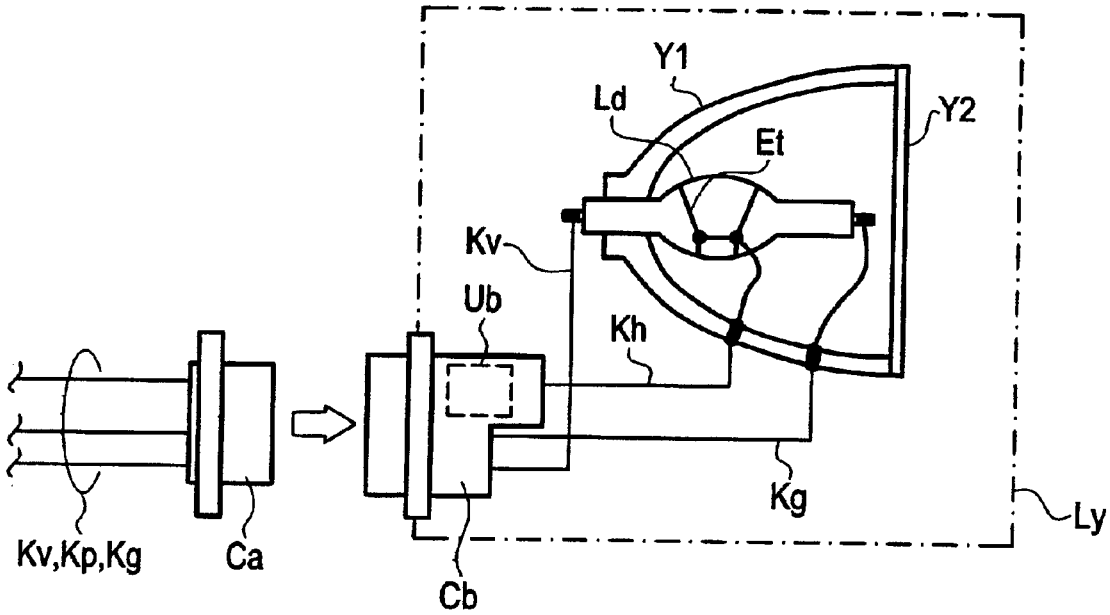
FIG. 3 sets forth a schematic of a first variation of the light source device of of FIG. 2.

In the invention according to its second embodiment, FIG. 3 shows a first variation of this embodiment of the invention. Here, of the connectors (Ca, Cb) for electrical connection of the feed circuit part (By) to the lamp unit (Ly), the connector (Cb) on the side of the lamp unit also have the function of a holding means for the high voltage generating part (Ub). This arrangement obviates the need for a means to attach the high voltage generating part (Ub) in the lamp unit (Ly). Furthermore, connection of the connector to the high voltage generating part (Ub) within the connector (Cb) takes place. As a result, a cable for connection of the connector to the high voltage generating part (Ub) is no longer necessary. Therefore, it is possible to contribute to a reduction in the size of the lamp unit (Ly).

Since a cable for connection of the connector to the high voltage generating part (Ub) is no longer necessary, the connection point between this cable and the connector or between this cable and the high voltage generating part (Ub) can be omitted. As a result, the possibility of the disadvantages, such as a faulty connection or the like, is reduced and an advantage is realized since the reliability increases. At the same time, the cable for connection of the connector to the high voltage generating part (Ub) is no longer necessary. In this embodiment, the labor input for connection and the labor input for attaching the high voltage generating part (Ub) in the lamp unit (Ly) are reduced, resulting in a reduction of labor costs.

Furthermore, the high voltage generating part (Ub) is automatically replaced by this arrangement when the lamp unit (Ly) is replaced, together with the connector (Cb) on the side of the lamp unit, after the service life of the lamp (Ld) expires. This results in a further advantage since conventionally for the high voltage transformer (Te) of the starter, which produces a high voltage, its insulation efficiency is inevitably degraded according to the frequency of use. In this embodiment, however, by replacing the lamp unit (Ly) the high voltage generating part (Ub) is replaced by a new part. Thus, the danger of insulation breakdown as a result of the degradation of the insulation efficiency of the high voltage generating part (Te) can be prevented beforehand.

Additionally, this arrangement makes it possible to handle the high voltage generating part (Ub) as a consumable. Therefore, its service life can be limited to a limited starting frequency per lamp (Ld). In this embodiment, the reliability which can be required of the high voltage generating part (Ub) can be improved compared to the conventional lamps where it is used as a long-term part. As a result, the costs for the arrangement of the high voltage generating part (Ub) and for the materials used for this part can be reduced.

Figure 4:
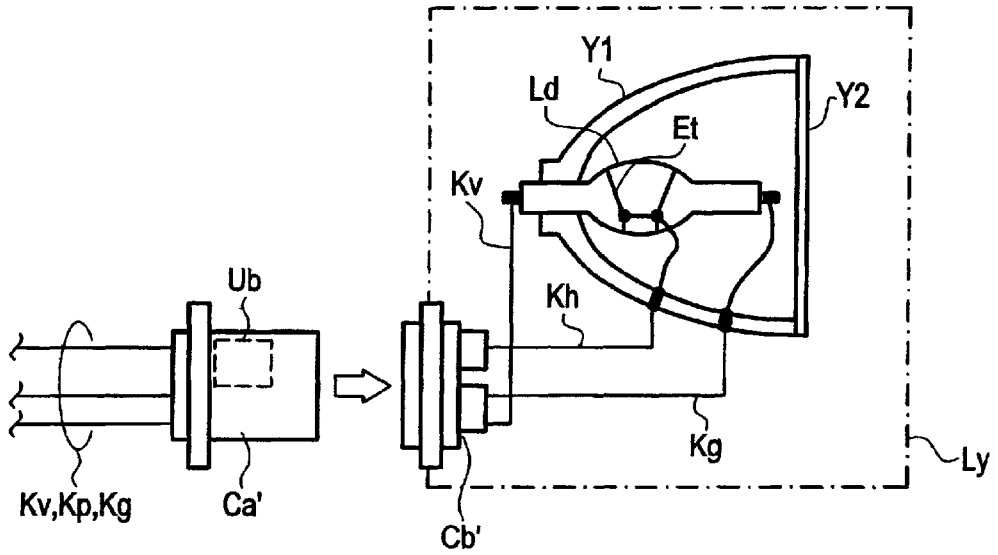
FIG. 4 sets forth a schematic of a second variation of the light source device of FIG. 2.

Alternatively, FIG. 4 shows another variation of the second embodiment of the invention. Here, the connectors (Ca', Cb') for electrical connection of the feed circuit part (By) to the lamp unit (Ly), in which the connector (Ca') is paired with the connector (Cb') on the side of the lamp unit, also have the function of a holding means for the high voltage generating part (Ub). In this arrangement, as well as in the first variation above, a means for mounting the high voltage generating part (Ub) in the lamp unit (Ly) and a cable for connection of the connector to the high voltage generating part (Ub) are no longer necessary.

This arrangement has the following advantages:

a reduction in the size of the lamp unit (Ly);

reduced faulty connections or the like;

an increase in reliability;

a reduction in the labor input for connection and of the labor input for mounting the high voltage generating part (Ub) in the lamp unit (Ly) and a reduction of labor costs.

Since the connector (Ca') which forms a pair with the connector (Cb') on the side of the lamp unit is not replaced in this embodiment, even if the lamp unit (Ly) is replaced, there is the advantage that the high voltage generating part (Ub) is not replaced. In this instance, the advantage which arises when the high voltage generating part (Ub) is handled as a consumable cannot be obtained; however, the number of parts of the lamp unit (Ly), which is replaced according to the replacement frequency of the high voltage generating part (Ub), is reduced when a high voltage generating part (Ub) has a long service life. Therefore, the advantage of reducing the costs for the lamp unit (Ly) are still realized.

Between the first variation and the second variation of this embodiment, the difference is in handling of the high voltage generating part (Ub) either as a consumable or a permanent part. Since each variation still has other advantages, i.e., with respect to costs and reliability and the like, the variation can be selected which is more advantageous at the time. Of course, a lamp arrangement can be provided in which the connectors for electrical connection of the feed circuit part (By) to the lamp unit (Ly), on both the connector on the side of the lamp unit as well as the connector which forms a pair with this connector, have the function of a means for securing part of the starter.

Figure 5:
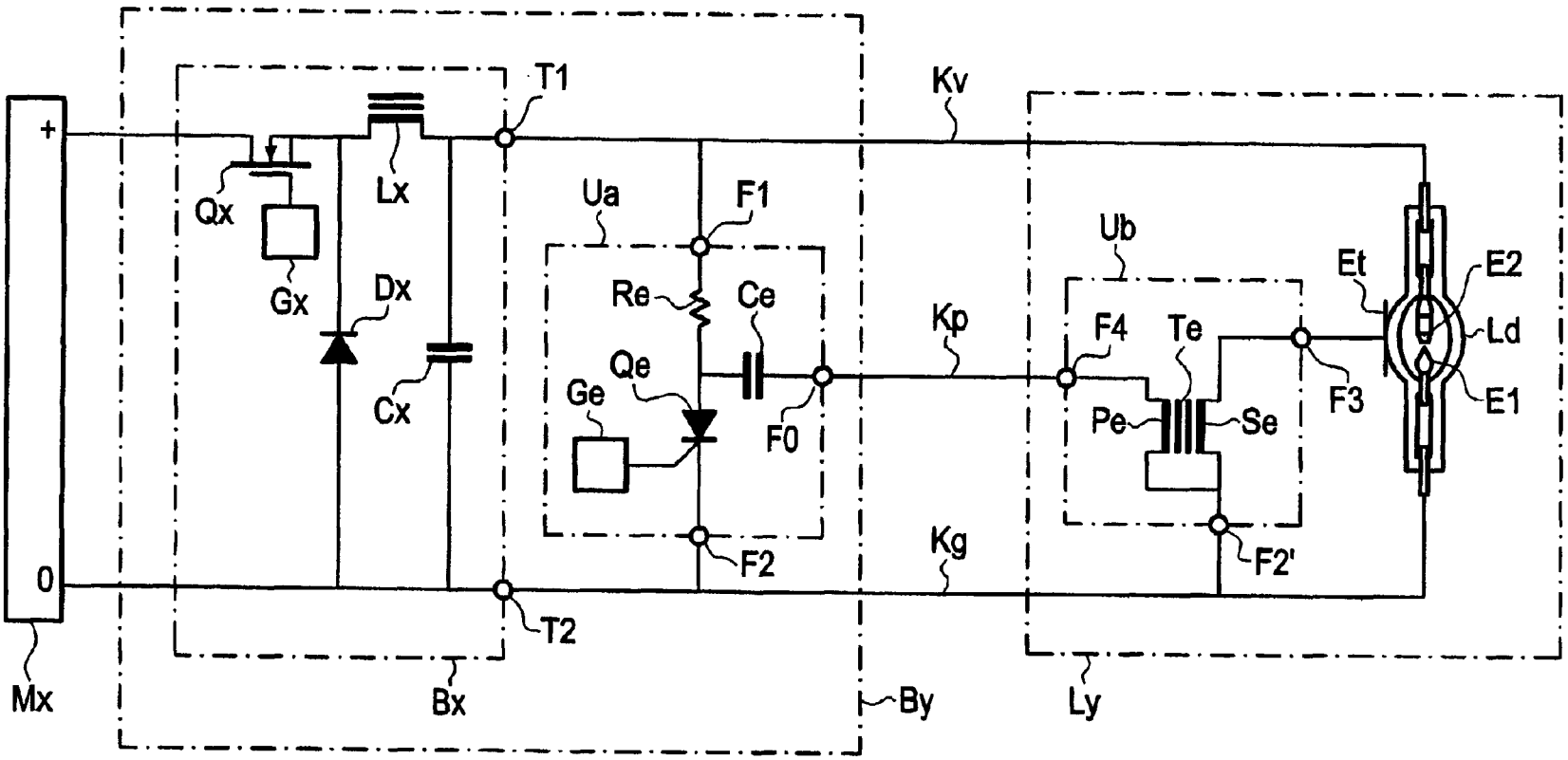
FIG. 5 sets forth a detailed schematic of the first embodiment of the invention of FIG. 1.

FIG. 5 illustrates one embodiment of FIG. 1 in a simplified representation. A DC source (Mx), which can be a power factor corrector (PFC) or the like, is connected to a feed circuit (Bx) of the voltage reduction chopper-type. In the feed circuit (Bx), using a switching device (Qx), such as a FET or the like, the current from the DC source (Mx) is turned on and off, and a smoothing capacitor (Cx) is charged via a choke coil (Lx). A gate signal with a suitable pulse duty factor from a gate driver circuit (Gx) is transferred to the switching device (Qx) such that the discharge current which flows between the electrodes (E1, E2) for the main discharge of the lamp (Ld). The voltage between the electrodes (E1, E2) for the main discharge or the lamp wattage as the product of this current has a suitable value which corresponds to the state of the lamp (Ld) at this instant.

Normally, for suitable control of the lamp current, of the lamp voltage or of the lamp wattage, a partial pressure resistance or a shunt resistance is provided for determining the voltage of the smoothing capacitor (Cx) and the current supplied by the smoothing capacitor (Cx) of the lamp (Ld). Furthermore, there is normally a control circuit which makes it possible for the gate driver circuit (Gx) to produce a suitable gate signal. These parts are however not illustrated in FIG. 5.

In the operation of the lamp (Ld), before starting, a no-load voltage is applied between the electrodes (E1, E2) for the main discharge of the lamp (Ld). Since the input point (F1) and the ground point (F2) of the starter drive part (Ua) are connected parallel to the lamp (Ld), the same voltage as the voltage applied to the lamp (Ld) is also supplied to the starter drive part (Ua). When this voltage is received, a capacitor (Ce) is charged via a resistor (Re) in the starter drive part (Ua).

By closing a switching device Qe, such as a SCR thyristor or the like, by a gate driver circuit (Ge) with suitable timing, a charging voltage is applied to the capacitor (Ce), and to the primary winding (Pe) of the high voltage transformer (Te) of the high voltage generating part (Ub) which is separated from the feed circuit part (By) and which is formed as an integral unit (Ly). In the secondary winding (Se) of the high voltage transformer (Te), an increased voltage is formed which corresponds to the arrangement of the high voltage transformer (Te).

In this embodiment, the voltage applied to the primary winding (Pe) decreases rapidly according to the discharge of the capacitor (Ce). The voltage which forms in the secondary winding (Se) similarly drops rapidly. The voltage which forms in the secondary winding (Se) therefore becomes a pulse. One end of the secondary winding (Se) of the high voltage transformer (Te) is connected to one of the electrodes of the lamp (Ld), specifically to the electrode (E1), which in this instance is the cathode. The other end of the secondary winding (Se) is connected to the auxiliary electrode (Et) which is located outside of the discharge vessel of the lamp (Ld). The high voltage which forms in the secondary winding (Se) produces a discharge between the auxiliary electrode (E1) of the lamp (Ld) and the inside of the discharge vessel of the lamp (Ld) through a dielectric barrier discharge. Thus, the main discharge is induced between the electrode (E1) and the other electrode (E2).

In FIG. 5, the high voltage of the starter is applied between the cathode side of the lamp and the auxiliary electrode. However, the high voltage can also be applied between the anode side of the lamp and the auxiliary electrode. In the embodiment described above for FIG. 5, the starter drive part (Ua) and the high voltage generating part (Ub) are connected by a line (Kp) which leads to one end of the primary winding (Pe) of the high voltage transformer (Te). Furthermore, in the high voltage generating part (Ub) the other end of the primary winding (Pe) of the high voltage transformer (Te) is connected via a terminal (F2') to an electrical circuit (Kg) which is a ground that is combined with the electrode (E1) of the lamp (Ld).

Therefore, the light source device can be operated by a connection of the feed circuit part (By) to the lamp unit (Ly) by only three lines (Kv, Kp, Kg), where line (Kv) connects to the anode (E2) of the lamp (Ld). Consequently, the advantage that the number of lines can be reduced is realized. However, since the line (Kg) of the ground is used jointly for the current of the main discharge of the lamp (Ld) and for the current of the primary winding (Pe) of the high voltage transformer (Te) of the high voltage generating part (Ub), the circuit is not balanced so it is possible for noise to form, for example from the line (Kp), for the current of the primary winding (Pe) of the high voltage transformer (Te).

Figure 6:
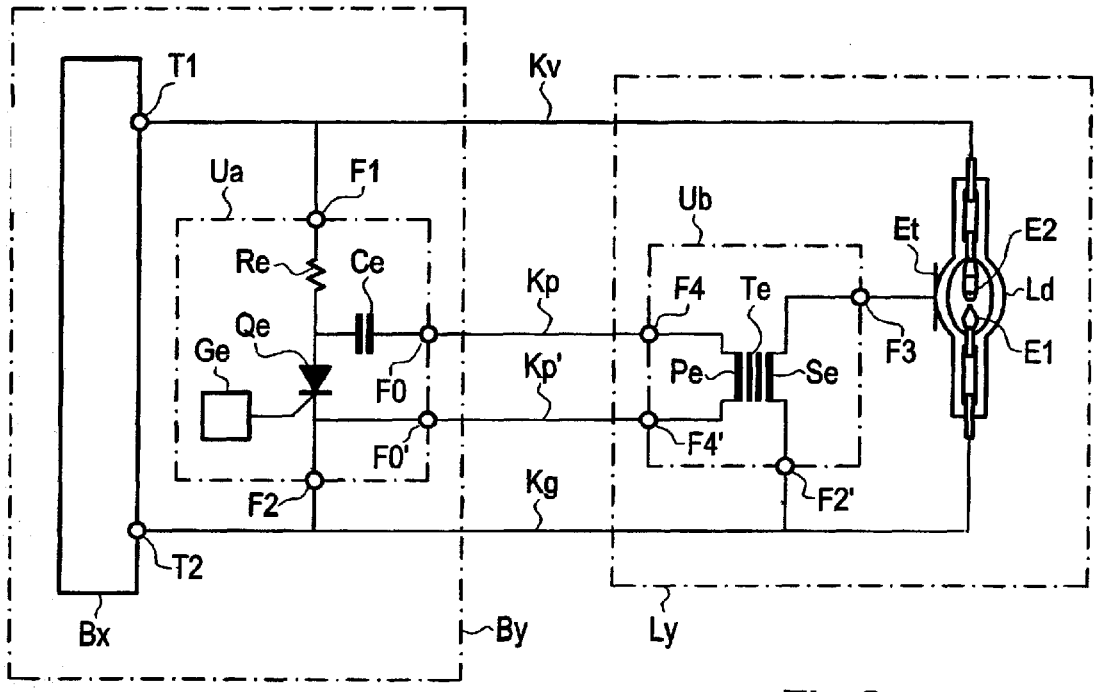
FIG. 6 sets forth another detailed schematic of the first embodiment of the invention of FIG. 1.

In FIG. 6, the line for the current of the main discharge of the lamp (Ld) and the current of the primary winding (Pe) of the high voltage transformer (Te) of the high voltage generating part (Ub) are separate from one another. This means that what was connected from the primary winding (Pe) of the high voltage transformer (Te) to the grounding point (F2') is connected via another terminal (F4') and by means of a line (Kp') which is used specifically for the starter drive part (Ua).

In this situation, the current of the primary winding (Pe) of the high voltage transformer (Te) flows only in the lines (Kp, Kp'), by which a balanced circuit is formed. Noise and a malfunction are therefore suppressed. Further, by twisting the lines (Kp, Kp') suppression of the noise can be increased even more. Additionally, the noise which is caused by the current surge which flows into the lamp (Ld) from the smoothing capacitor (Cx), when the main discharge is started, is suppressed by the twisted lines (Kv, Kg) for the main discharge.

The reason why the lines can be twisted in this embodiment is that in the situation when the high voltage generating part (Ub), which comprises the high voltage transformer (Te), is separated from the feed circuit part (By) and the lamp (Ld) and the high voltage generating part (Ub) are formed as a one-part unit (Ly), there is no need to lay a high voltage-carrying line for the line paths between the feed circuit part (By) and the lamp unit (Ly). As a result, a line with low voltage stability, a thin insulation coating and a small coating diameter can be used which is a major advantage of the invention.

Figure 7:
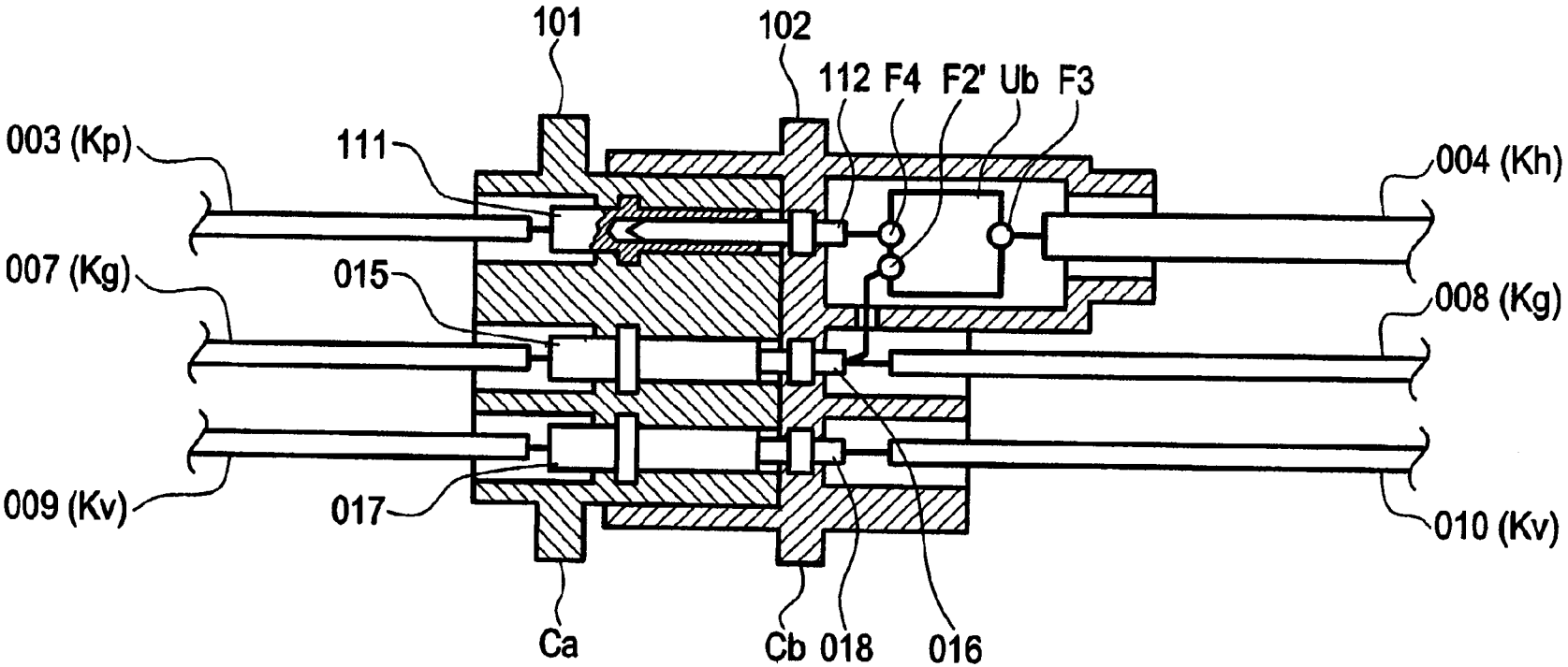
FIG. 7 sets forth a detailed cross section of the first variation of the light source device of FIG. 3.

FIG. 7 illustrates a detailed cross section of the first variation of the light source device of FIG. 3 in a simplified representation. Specifically, the arrangement of the connectors (Ca, Cb) in the situation in which the connector (Cb) on the side of the lamp unit also functions as a holding means for the high voltage generating part (Ub). The circuit corresponds to the circuit described above using FIG. 5. Of the lines between the feed circuit part (By) and the lamp unit (Ly), the line (Kg) is connected to the cathode (E1) of the lamp (Ld) by a contact of the contactor (015) to which the cable conductor of a cable (007) is connected. Additionally, a contactor (016) is provided to which the cable conductor of a cable (008) is connected. The line (Kv) to the anode (E2) of the lamp (Ld) is connected by a contactor (017) with the cable conductor of the cable (009), and with a contactor (018) to which the cable conductor of a cable (010) is connected.

Similarly, the line (Kp) between the starter drive part (Ua) and the high voltage generating part (Ub) is connected by the contact of a contactor (111) to the cable conductor of a cable (003), and with a contactor (112) to which one terminal (F4) of the high voltage generating part (Ub), located in a cage-like connector body (102), is directly connected. Furthermore, the terminal (F2'), which is to be connected to the ground line path (Kg) of the high voltage generating part (Ub), is directly connected to the contactor (016). The cable conductor of the high voltage cable (004) is connected to the high voltage output terminal (F3) of the high voltage generating part (Ub).

Figure 8:
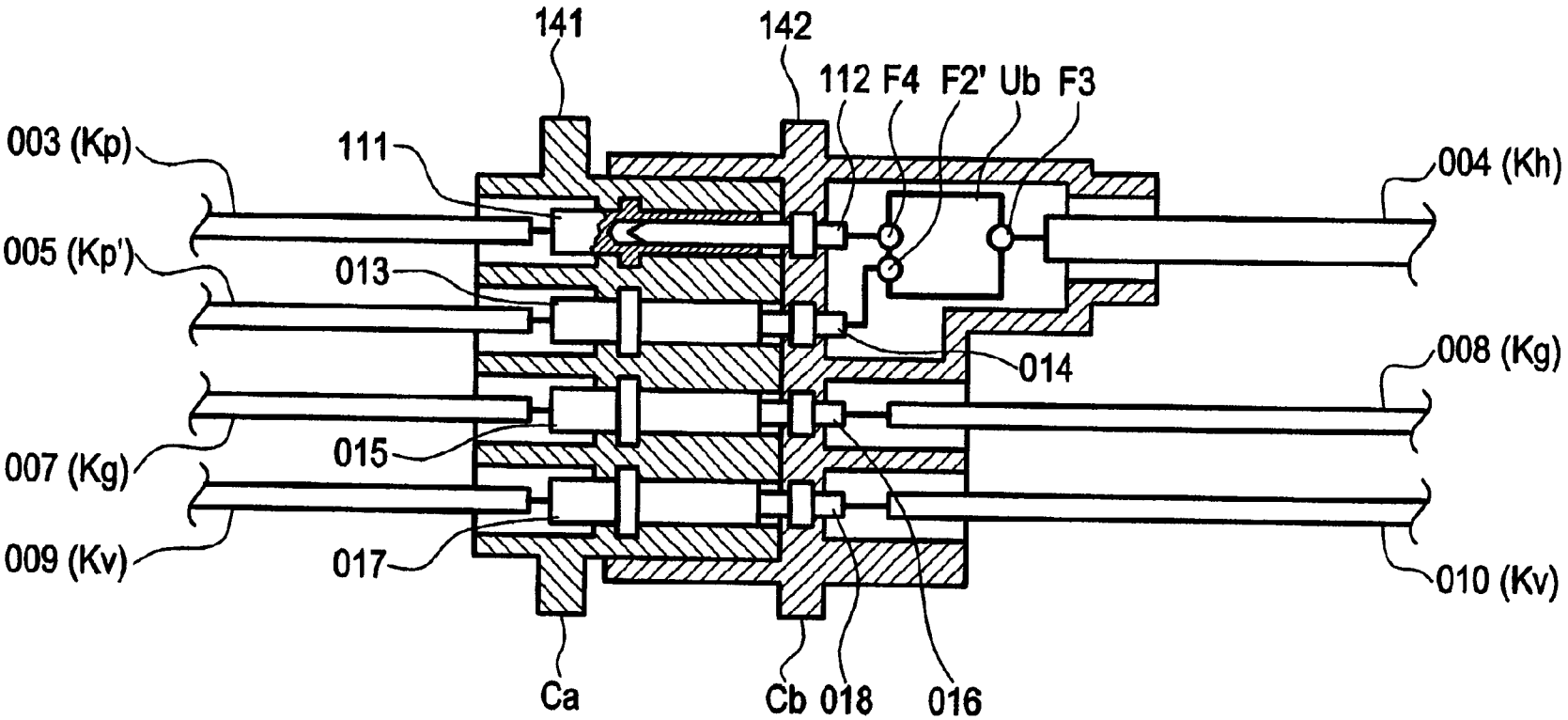
FIG. 8 sets forth another detailed cross section of a variation of the light source device of FIG. 3.

FIG. 8 similarly shows, in a simplified representation, another cross section of a variation of the light source device of FIG. 3. Specifically, the arrangement of the connectors (Ca, Cb) in this variation includes a connector (Cb) on the side of the lamp unit that also functions as a receiving vessel and holding means for the high voltage generating part (Ub). The circuit corresponds to the circuit described above using FIG. 6.

In this embodiment, in comparison to the connectors shown in FIG. 7, a pair of contact arrangements are added to the cage-like connector bodies (141, 142). An additional line (Kp') between the starter drive part (Ua) and the high voltage generating part (Ub) is connected by a contact of the contactor (013) to which the cable conductor of a cable (005) is connected, and with a contactor (014) to which one terminal (F2') of the high voltage generating part (Ub) is directly connected.

Figure 9:
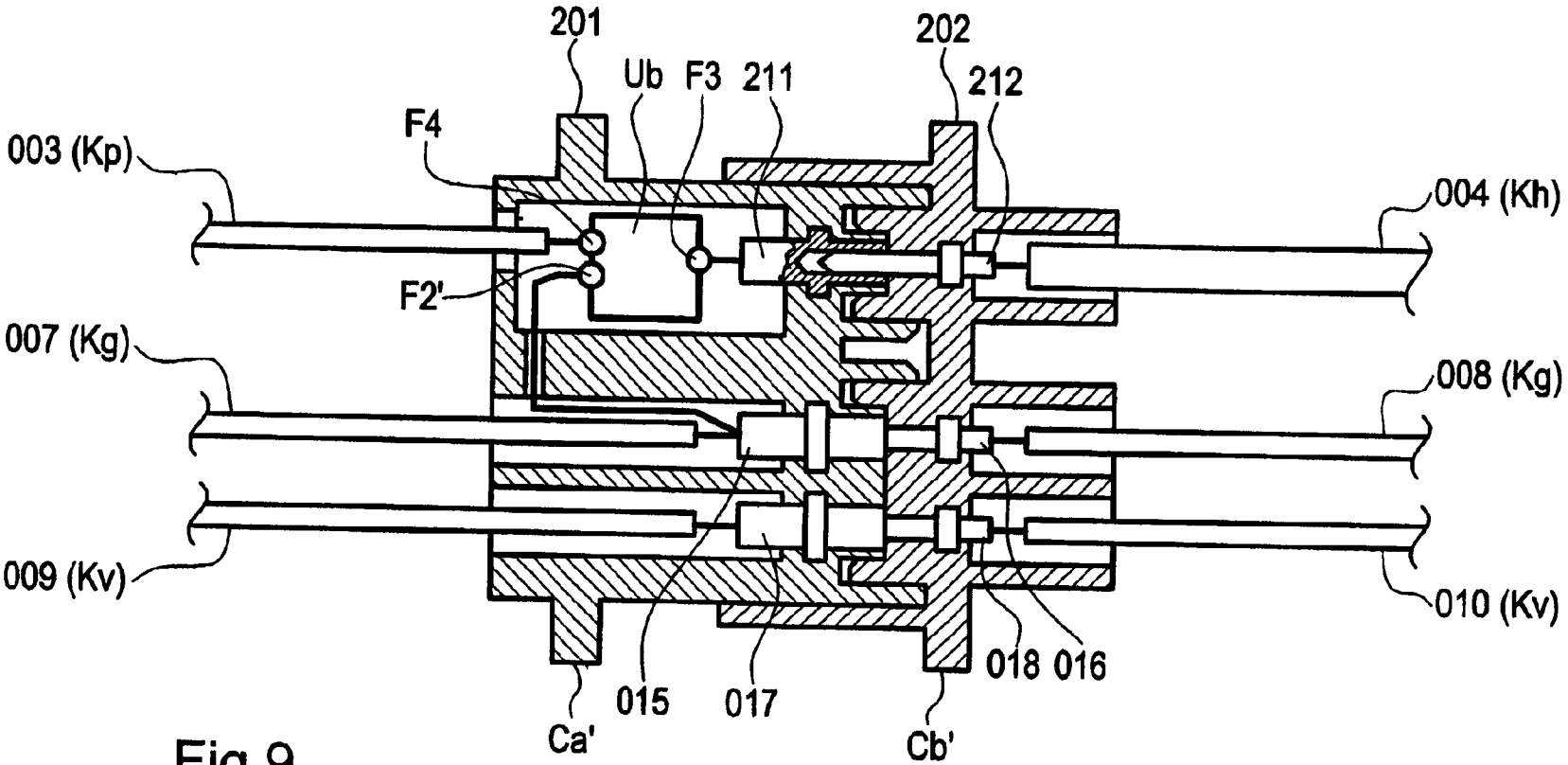
FIG. 9 sets forth a detailed cross section of the second variation of the light source device of FIG. 4.

FIG. 9 illustrates a cross section of the second variation of the light source device of FIG. 4 in a simplified representation. Specifically, the arrangement of connectors (Ca', Cb') in this instance is such that the connector (Ca'), which forms a pair with the connector (Cb') on the side of the lamp unit, also functions of a receiving part and a holding means for the high voltage generating part (Ub). The circuit corresponds to the circuit described above using FIG. 5.

Of the lines between the feed circuit part (By) and the lamp unit (Ly), the connections of the line (Kg) to the cathode (E1) of the lamp (Ld) and the line (Kv) to the anode (E2) of the lamp (Ld) are identical to those in the connectors described above in FIG. 7. However, in line (Kp), between the starter drive part (Ua) and the high voltage generating part (Ub), the cable conductor of the cable (003) is directly connected to the terminal (F4) of the high voltage generating part (Ub) which is located in the cage-like connector body (201).

Furthermore, a terminal (F2') is to be connected to the ground line (Kg) of the high voltage generating part (Ub) that is connected with contactor (015). A high voltage-carrying line (Kh) is connected on one end by one contact of a contactor (211) and at another end by a high voltage output terminal (F3) directly connected to the high voltage generating part (Ub). The contactor (212) also connects to the high voltage cable (004).

Figure 10:
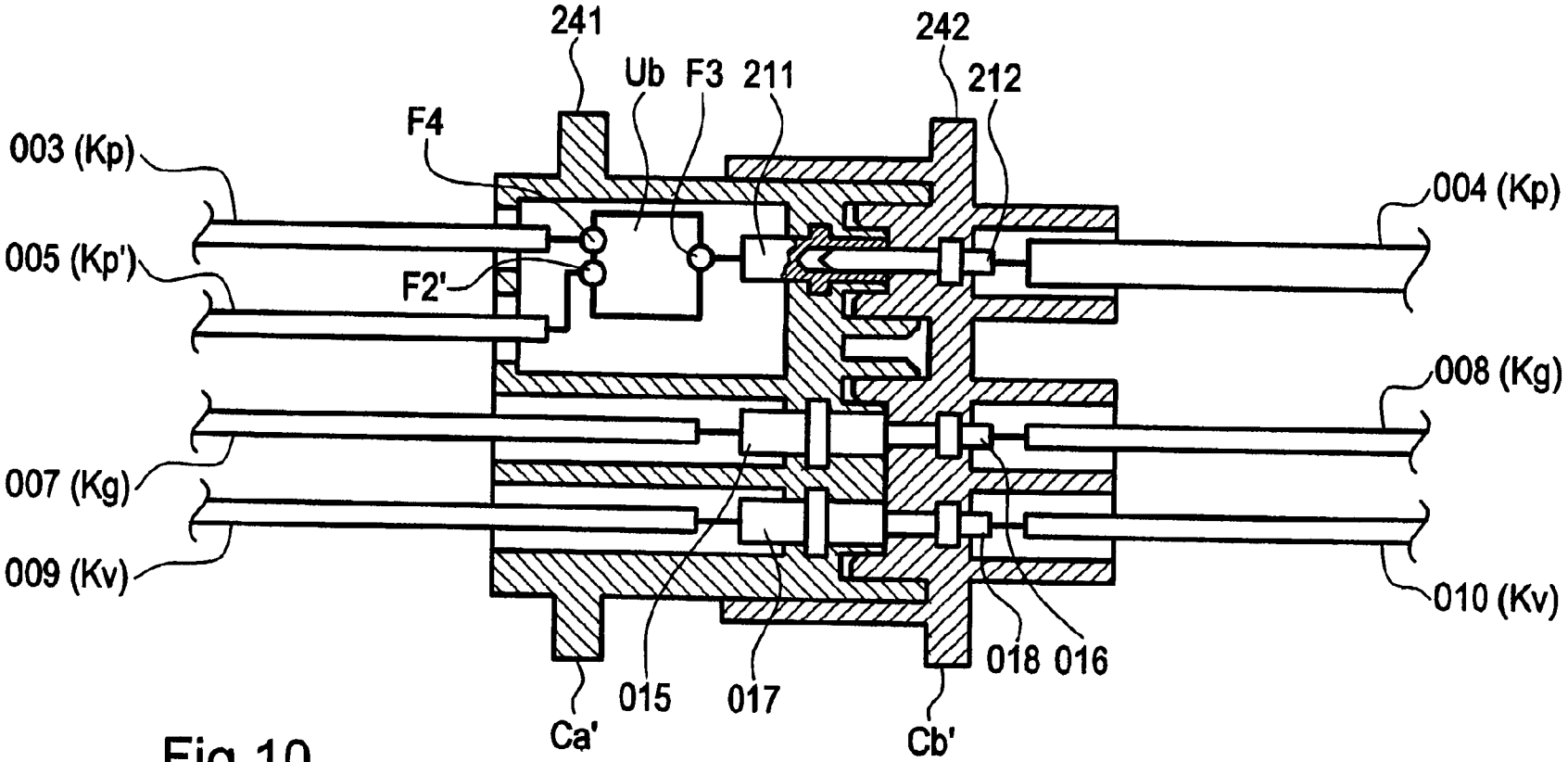
FIG. 10 sets forth another detailed cross section of a variation of the light source device of FIG. 4.

FIG. 10 similarly shows, in a simplified representation, another cross section of a variation of the light source device of FIG. 4. Specifically, the arrangement of connectors (Ca', Cb') in this instance is such that the connector (Ca'), which forms a pair with the connector (Cb') on the side of the lamp unit, also functions of a receiving part and a holding means for the high voltage generating part (Ub). The circuit corresponds to the circuit described in FIG. 6.

In this instance, in comparison to the connectors shown in FIG. 9, one line in addition is connected to the cage-like connector body (241). For the additional line (Kp') between the starter drive part (Ua) and the high voltage generating part (Ub), the cable conductor of the cable (005) is directly connected to one terminal (F2') of the high voltage generating part (Ub) located in the cage-like connector body (241).

In the embodiments as shown in FIGS. 7 to 10, variations of the concepts of the invention are illustrated. In the practical use of an actual light source device, it is of course assumed that various methods which are practiced in conventional connector installation technology are used. For example, the contactor is produced by pressing a plate of a conductive material which is suitable as an elastic material, for example phosphor bronze. In forming a connection of the cables, which includes not only the cable conductors but also the coating on the cable conductors, the process used will be, for example, a compression connection or the like with the contactors.

When the contactors, which have been connected to the cables mounted in the cage-like connector bodies, are to be installed the process is simplified by a connector arrangement having installation openings for the contactors that have been elastically widened so that the contactors, when inserted in the installation openings, are supported inside of the installation openings so that removal can only be performed by a special tool. With this construction, when the cable conductor of the cable is directly connected to the terminal of the high voltage generating part (Ub) which is located in the cage-like connecting body, tension or fatigue on the cable, which is tensioned or swiveled, will be prevented from occurring on the point at which the cable conductor is connected to the terminal of the high voltage generating part (Ub).

For example, using a conductive holding body which has the complementary connection arrangement to the cable and the same installation arrangement in the cage-like connector body as the contactors, the cable and the cage-like connector body can be coupled to one another and the terminal of the high voltage generating part (Ub) which is located in the cage-like connector body can be electrically connected to the holding body. For electrical connection of the terminal of the high voltage generating part (Ub) to the holding body a technique such as soldering, compression connection, pressure welding, clamping and the like can be used.

In an additional example, a connection arrangement can be provided in which the cable coating is clamped and attached directly by a cage-like connector body or in which the cable coating is clamped by using an auxiliary component and is therefore indirectly attached to the cage-like connector body. Examples of a mechanism for direct or indirect attachment of the cable coating to the cage-like connector body are U-shape construction or a construction in which clamping is done by the cover of the holding chamber of the high voltage generating part (Ub). Alternatively, the cable coating can simply be cemented to the cage-like connector body.

When the cable is attached, the cable conductor can be connected to the terminal of the high voltage generating part (Ub), e.g., by soldering or using a compression connection sleeve. Of course, the three-dimensional distance or creep length which is required for safety should be ensured between the high voltage output terminal (F3) of the high voltage generating part (Ub) and the charging part which is electrically connected thereto.

In the embodiments shown in FIGS. 5 & 6, the use of a starter which produces a pulsed high voltage is illustrated. However, the excellent advantages of the invention of this embodiment can be realized regardless of the starter circuit type or the voltage waveform applied by the starter circuit to the auxiliary electrode (Et) of the discharge lamp (Ld).

Figure 11:
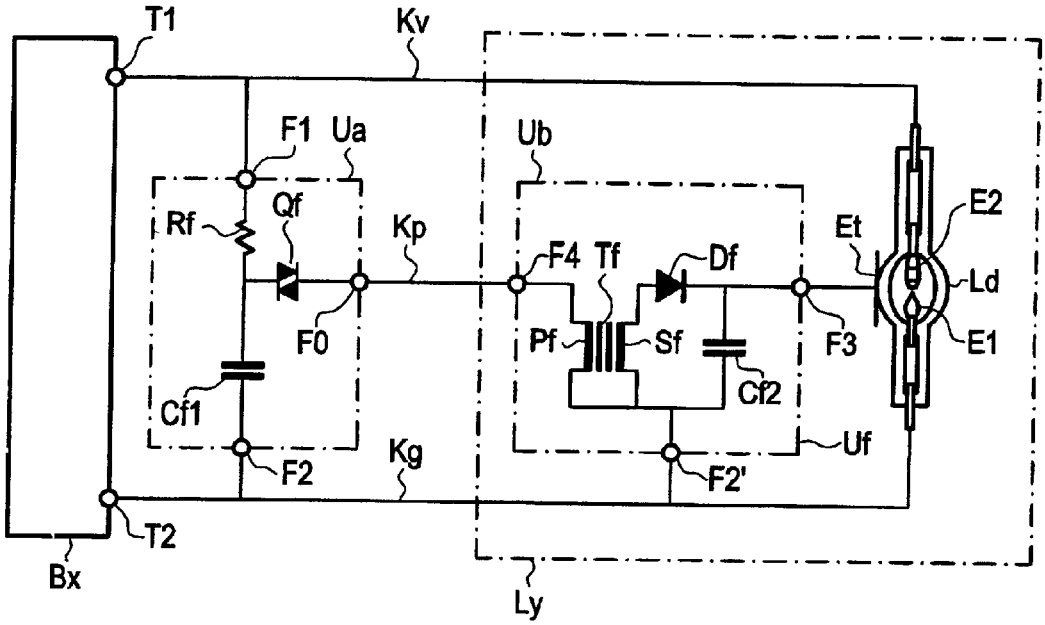
FIG. 11 sets forth a schematic of an embodiment of the invention in which another starter is used.

FIG. 11 illustrates an embodiment in which a starter is used which produces a high voltage but in which the voltage rises relatively slowly. Since the input point (F1) and the ground point (F2) of the starter drive part (Ua) are connected parallel to the lamp (Ld), as in FIGS. 5 and 6, the no-load voltage which has been applied to the lamp (Ld) is also supplied to the input point (F1) and the ground point (F2). When this voltage is received, charging of the capacitor (Cf1) is begun in the starter drive part (Ua) via a resistor (Rf). Closing of the switching device (Qf), such as a SIDAC or the like, takes place by itself when the voltage of the capacitor (Cf1) is charged up to a given threshold voltage. This voltage is applied to the primary winding (Pf) of the high voltage transformer (Tf) of the high voltage generating part (Ub), which is separate from the feed circuit part (By) and is formed as integral unit (Ly). A capacitor (Cf2) on the secondary side is charged via a diode (Df) which is connected to the secondary winding (Sf).

When the discharge of the capacitor (Cf1) on the primary side continues and when the current reaches a value which is less than or equal to a given value, the switching device (Qf) is shifted by itself into the non-closed state.

Thus, charging of the capacitor (Cf1) is started again. Each time the capacitor (Cf1) is charged or discharged, the charge of the capacitor (Cf2) on the secondary side is cumulated. Its voltage is increased more and more. When the voltage of the capacitor (Cf2) reaches the ignition voltage, between the one electrode (E1) of the lamp (Ld) and the inside of the discharge vessel of the lamp (Ld), a discharge is formed by the dielectric barrier discharge. This is due to one end of the capacitor (Cf2) being connected to one electrode (E1) (in this case the cathode) of the lamp (Ld) and the other end of the capacitor (Cf2) is connected to an auxiliary electrode (Et) which is located outside of the discharge vessel of the lamp (Ld).

When this discharge has formed, the lamp has been started and when a transition to the arc discharge has been successfully carried out, the voltage applied to the lamp (Ld) decreases, i.e., as a result the voltage supplied to the starter drive part (Ua), as a result the charging voltage of the capacitor (Cf1) decreases and the switching device (Qf) is shut down.

Figure 12:
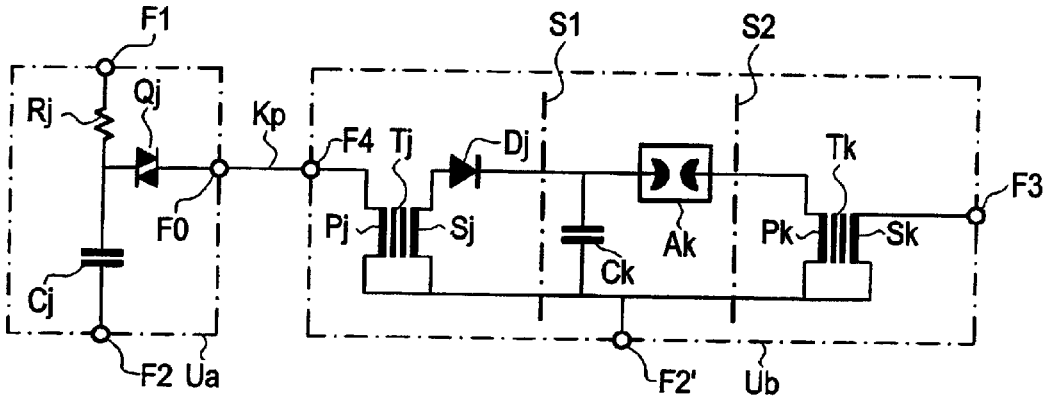
FIG. 12 shows another schematic of an embodiment of the invention in which yet another starter is used.

In FIG. 11, the high voltage of the starter is applied between the cathode side of the lamp and the auxiliary electrode. But it can also be applied between the anode side of the lamp and the auxiliary electrode. Furthermore, the starter shown in FIG. 12 can also be used; it can be considered a "two-stage voltage raising type". In a similar embodiment as the charging operation of the capacitor (Cf2) of the circuit shown in FIG. 11, a capacitor (Ck) of the high voltage generating part (Ub) which is separate from the feed circuit part (By) and which is formed as an integral unit (Ly) is charged.

When charging of the capacitor (Ck) continues, a discharge gap element (AK), such as a surge arrestor or the like, discharges and a voltage is applied to the primary winding (Pk) of a high voltage transformer (Tk), as a result a pulsed high voltage is produced in the secondary winding (Sk) of the high voltage transformer (Tk). The pulsed high voltage is applied via one terminal (F3) to the auxiliary electrode (Et) which is located outside of the discharge vessel of the lamp (Ld). In a light source device with such a starter circuit system, the outstanding advantages of the invention mentioned above are realized.

When the starter is divided into the starter drive part (Ua) and the high voltage generating part (Ub) which comprises at least the high voltage transformer, when the high voltage generating part (Ub) is separated from the feed circuit part (By) and when the unit (Ly) which is integral with the lamp (Ld) is formed, the manner of division of the components can be suitably depending on the needs of the light source device. For example, in the starter shown in FIG. 12, a switching device (Qj), such as a SIDAC or the like, and the primary winding (Pj) of a step-up transformer are separated from one another. Additionally, the diode (Dj) and the capacitor (Ck) (see boundary line S1) can also be separated from one another or from the discharge gap element (AK) which in turn can be separated from the primary winding (Pk) of the high voltage transformer (Tk) (see boundary line S2).

In the embodiments of the invention described above, a DC discharge voltage is applied to form the main discharge of the lamp (Ld). However, each of the advantages of the invention described above can be realized when an AC discharge voltage is applied.

Figure 13:
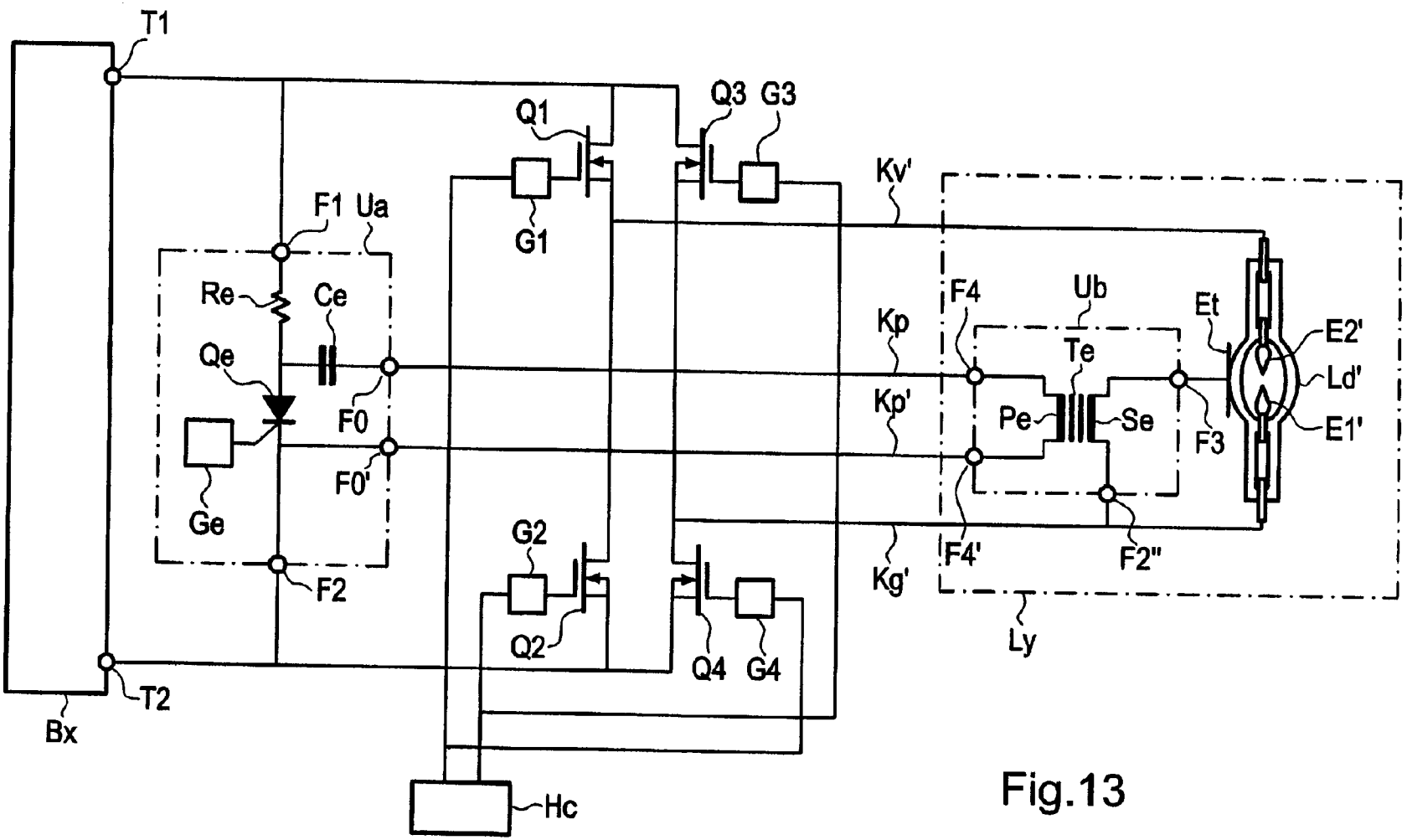
FIG. 13 sets forth a schematic of an embodiment of the invention in which an alternating discharge voltage is applied.
Figure 14:
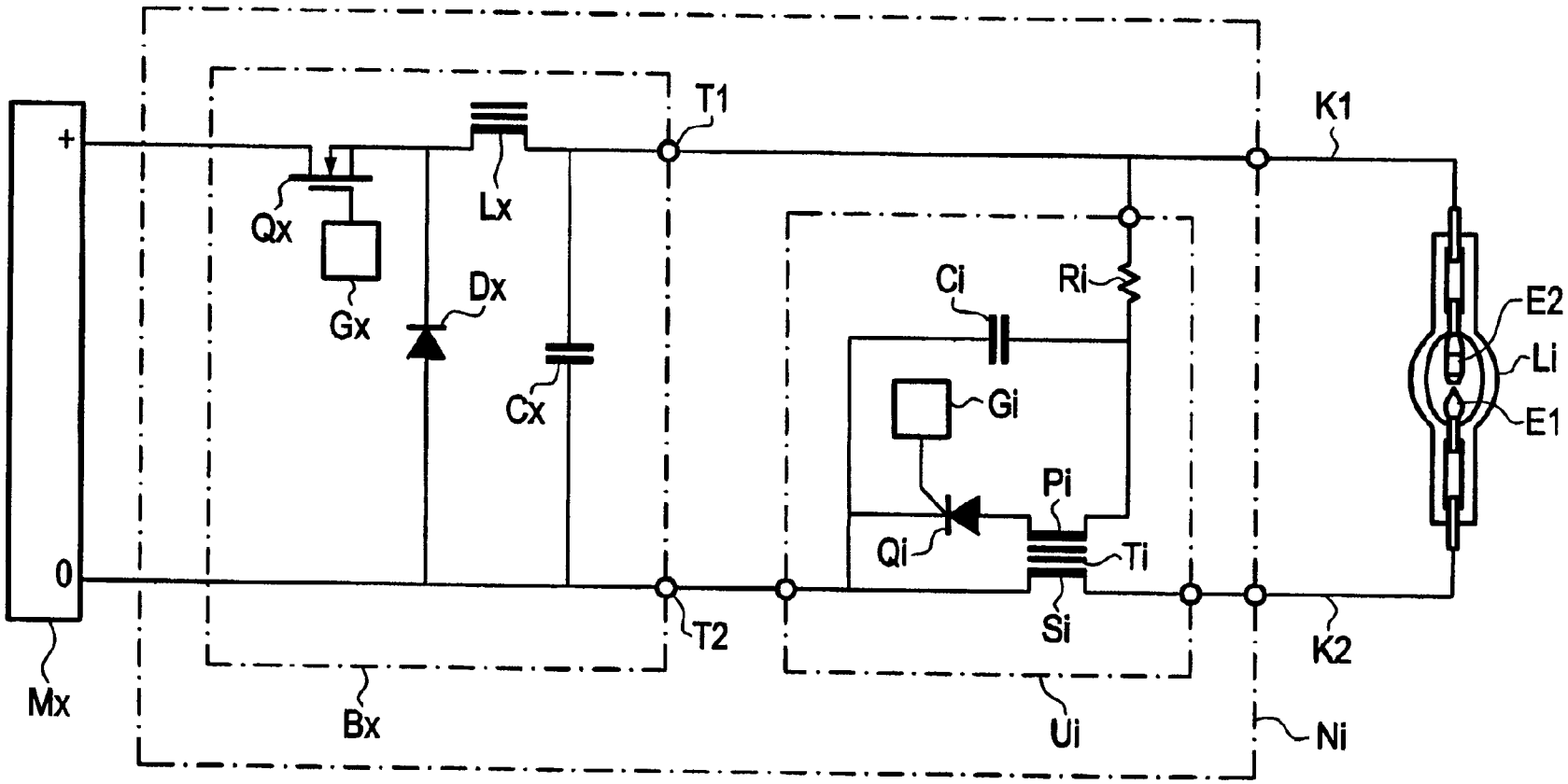
Fig.14 (Prior Art)
FIG. 14 sets forth a schematic of a conventional light source device.

FIG. 13 shows yet another embodiment of the invention in a simplified representation. In the circuit in FIG. 13, when compared to the circuit shown above in FIG. 6, switching devices (Q1, Q2, Q3, Q4), such as FETs or the like, were added and thus a full bridge inverter was formed. It is thus possible to apply an alternating discharge voltage to the lamp (Ld').

The switching devices (Q1, Q2, Q3, Q4) are each driven by gate driver circuits (G1, G2, G3, G4) which are controlled by a full bridge inverter control circuit (Hc) such that the switches (Q1, Q4) and the switches (Q2, Q3) which are each the diagonal elements of the full bridge inverter are closed at the same time.

The high voltage, which forms at the output points (F3, F2") of the high voltage generating part (Ub), is applied between one electrode (E1') for the main discharge of the lamp (Ld') and the auxiliary electrode (Et). A discharge, by which the main discharge is induced, is formed by a dielectric barrier discharge between the one electrode (E1') and the inside of the discharge vessel of the lamp (Ld').

If the timing of the switching to the closed states of the switching devices (Q1, Q2, Q3, Q4) of the full bridge inverter (and the formation of the high voltage of the starter) is unfavorable with respect to the discharge starting of the lamp, the disadvantage with respect to the timing can be avoided when the discharge start the lamp either by synchronization such that the timing of the switching of the closed states of the switching devices (Q1, Q2, Q3, Q4) and of the formation of the high voltage of the starter becomes correct, or by stopping the full bridge inverter until discharge starting of the lamp is completed.

The starter in the circuit in FIG. 13 can also be replaced by the starter which is shown above using FIG. 11 and which produces a high voltage at which the voltage increases relatively slowly, although this is not shown in FIG. 13.

In each of the embodiments of the invention, a feed circuit (Ex) of the voltage reduction chopper circuit type is shown. However, the advantages of the invention described above can be realized in other circuit types or in an arrangement in which the feed circuit also acts as the DC source (Mx).

Relative to the embodiments of the invention, it was described that the starter drive part (Ua) is located in the feed circuit part (By). However, the starter drive part (Ua) can also be separately located. Additionally, an embodiment where starter drive part (Ua) is essentially not present because the high voltage generating part (Ub) of the starter is the entire starter circuit, is still another embodiment of the invention.

What we claim is:

1. Light source device comprising:

a discharge lamp including a pair of opposed electrodes located in a discharge space and an auxiliary electrode located outside of the discharge space;

a feed circuit for supplying a discharge current to the opposed electrodes; and a starter circuit assembly including a high voltage generating part which produces a high voltage between one of the opposed electrodes and the auxiliary electrode;

wherein the high voltage generating part of the starter circuit assembly includes at least a high voltage transformer that is separated from the feed circuit;

wherein the feed circuit is separated from the starter circuit; and wherein the discharge lamp and the high voltage generating part are formed as an integral unit.

2. Light source device as claimed in claim 1, further including a connector body for establishing electrical connection of the feed circuit part to the integral unit; wherein the high voltage generating part is supported by the connector body.

3. Light source device as claimed in claim 2, wherein the connector body comprises two separable components; wherein the high voltage generating part is held within one of said two separable components with the discharge lamp.

4. Light source device as claimed in claim 1, wherein the integral unit comprises first and second separable components; wherein the high voltage generating part is supported within either separable component.

5. Light source device as claimed in claim 4, wherein the second separable component is integrally formed with the integral unit and the high voltage generating part is supported within the second separable component.

6. Light source device as claimed in claim 4, wherein the first separable component is separable from the integral unit and the high voltage generating part is supported within the first separable component.

7. Light source device as claimed in claim 1, wherein the auxiliary electrode is supported on an exterior surface of the discharge lamp.

8. Light source device as claimed in claim 1, wherein the starter circuit assembly includes components other than the high voltage generating part and which are separate from the integral unit.

9. Light source device comprising:

a discharge lamp including a pair of opposed electrodes located in a discharge space and an auxiliary electrode which is located outside of the discharge space;

a feed circuit for supplying a discharge current to the opposed electrodes; and a starter circuit assembly including a high voltage generating part which produces a high voltage between one of the opposed electrodes and the auxiliary electrode;

wherein the starter circuit is separated from the feed circuit and the high voltage generating part of the starter circuit assembly includes at least a high voltage transformer that is located a sufficient distance from the feed circuit to reduce noise in conductive lines of the discharge device during startup of the discharge lamp; and wherein the discharge lamp and the high voltage generating part are formed as an integral unit.

10. Light source device as claimed in claim 9, wherein the feed circuit is formed as a separate component from the integral unit.

11. Light source device as claimed in claim 9, further including a connector body for establishing electrical connection of the feed circuit part to the integral unit wherein the high voltage generating part is supported by the connector body.

12. Light source device as claimed in claim 11, wherein the connector body comprises two separable components; wherein the high voltage generating part is held within one of the two separable components with the discharge lamp.

13. Light source device as claimed in claim 9, wherein the integral unit comprises first and second separable components; wherein the high voltage generating part is supported within either separable component.

14. Light source device as claimed in claim 13, wherein the second separable component is integrally formed with the integral unit and the high voltage generating part is supported within the second separable component.

15. Light source device as claimed in claim 13, wherein the first separable component is separable from the integral unit and the high voltage generating part is supported within the first separable component.

16. Light source device as claimed in claim 9, wherein the auxiliary electrode is supported on an exterior surface of the discharge lamp.

17. Light source device as claimed in claim 9, wherein starter circuit assembly includes components other than the high voltage generating part and which are separate from the integral unit.

18. Light source device as claimed in claim 17, wherein the other starter circuit assembly components are connected with the feed circuit.

19. Light source device as claimed in claim 18, wherein the other starter circuit assembly components are part of another integral unit which includes the feed circuit.

* * * * *